US006642647B2

(12) United States Patent
Taniguchi et al.

(10) Patent No.: US 6,642,647 B2
(45) Date of Patent: Nov. 4, 2003

(54) CATHODE RAY TUBE HAVING A PIGMENT ON A PANEL FRONT FACE

(75) Inventors: Maki Taniguchi, Ichihara (JP); Masahiro Nishizawa, Mobara (JP); Norikazu Uchiyama, Chikura (JP); Toshio Tojo, Ichinomiya (JP)

(73) Assignee: Hitachi, Ltd., Tokyo (JP)

( * ) Notice: Subject to any disclaimer, the term of this patent is extended or adjusted under 35 U.S.C. 154(b) by 98 days.

(21) Appl. No.: 09/769,626

(22) Filed: Jan. 25, 2001

(65) Prior Publication Data

US 2002/0135291 A1 Sep. 26, 2002

(51) Int. Cl.[7] ..... H01J 31/00
(52) U.S. Cl. ..... 313/477 R; 313/479
(58) Field of Search ..... 313/477 R, 478, 313/479, 480, 110, 112

(56) References Cited

U.S. PATENT DOCUMENTS

| | | | |
|---|---|---|---|
| 4,563,612 | A | 1/1986 | Deal et al. |
| 4,945,282 | A | 7/1990 | Kawamura et al. |
| 5,291,097 | A | 3/1994 | Kawamura et al. |
| 5,412,278 | A | 5/1995 | Iwasaki |
| 5,464,566 | A | 11/1995 | Ito et al. |
| 5,520,855 | A | 5/1996 | Ito et al. |
| 5,599,579 | A | 2/1997 | Iwasaki |
| 5,627,429 | A | 5/1997 | Iwasaki |

FOREIGN PATENT DOCUMENTS

| | | | |
|---|---|---|---|
| EP | 999458 | A2 * | 5/2000 |
| JP | 51101/1986 | | 3/1986 |
| JP | 10-162756 | | 6/1998 |
| JP | 2000 111705 | | 4/2000 |
| JP | 2000-230152 | | 8/2000 |
| JP | 2000-258625 | | 9/2000 |

* cited by examiner

*Primary Examiner*—Joan Pendegrass
(74) *Attorney, Agent, or Firm*—Milbank, Tweed, Hadley & McCloy, LLP

(57) ABSTRACT

A color cathode ray tube is generally constituted from a panel section for visually displaying images and a neck portion containing therein an electron gun assembly plus a funnel section for coupling the panel section and the neck portion together. The panel comprises on its outer surface a colored film that includes a coloring matter or pigment for color-selective absorption of light rays and fine or micro-particles with electricity-resistant property for letting the pigment scatter or disperse.

With said arrangement, it is possible to improve the light absorbability of the colored film, thereby enabling provision of the intended cathode ray tube with improved contrast.

4 Claims, 8 Drawing Sheets

CATHODE RAY TUBE HAVING A PIGMENT ON A PANEL FRONT FACE

BACKGROUND OF THE INVENTION

The present invention relates to cathode ray tubes and, more particularly, to a cathode ray tube with improved contrast.

A cathode ray tube typically includes a glass-made outer envelop which is designed to consist essentially of a panel section for visually displaying images, a neck portion housing therein an electron gun assembly, and a funnel section for coupling the panel section and the neck portion together.

An electron beam that emitted from an electron gun impinges on a layer of fluorescent or phosphor material that formed on the inner surface of a face plate, thereby permitting light emission of the phosphor material. The face plate has its part with picture elements or "pixels" formed therein, which is for use as a display screen. A color cathode ray tube has been provided which has its phosphor layer that is reduced in pitch in order to display high-resolution images. The quest for higher resolution of on-screen images results in the improvement in display image contrast required.

It is also noted that color cathode ray tubes of the flat panel type with a front panel face made substantially flat have been widely employed as picture tubes of television receivers and/or personal computer monitor units. Screen flattening makes it possible to improve on-screen image viewabilities.

Since the glass envelop of a cathode ray tube is evacuated to a high degree of vacuum in its interior space, plate thicknesses at respective portions of the glass envelop are set at specific values for enabling them to withstand atmospheric or barometric pressures. Especially, the face plate of a flat-panel type cathode ray tube is such that the plate thickness of a peripheral portion is greater in value than that at a central portion.

Due to this, the brightness or luminance of an image being displayed on the face plate decreases at peripheral portions, as compared to that at the central portion of the face plate. Furthermore, the weight of phosphor becomes smaller at the screen periphery than at the screen center, resulting in a further decrease in luminance. To preclude such luminance reduction at the periphery, certain panels with transmittance of more than 70% are usually employed.

However, the use of such high-transmittance panels can result in a decrease in contrast of images.

One known technique for improving the image contrast is to fabricate a colored film on the front face of a panel for appropriate adjustment of spectral transmittance. It is well known among those skilled in the art that the colored film is formed by sol-gel methods. For example, deposit on the panel's front face a mixture liquid of metal alkoxide and alcohol along with water and coloring pigment, and thereafter perform baking or sintering it to thereby form the colored film required.

Since the pigment readily exhibits flocculation in a metal alkoxide liquid, it has been difficult to retain dispersion of pigment in the metal alkoxide liquid for an increased length of time period. If flocculated pigment resides on the panel face then light rays can scatter or disperse due to such flocculated pigment, resulting in loss of optical transparency. Further, the presence of the flocculated pigment would result in lack of clearness or crispness of display images, leading to blur thereof.

On the other hand, addition of an increased amount of dispersing agent into the mixture liquid for suppression of pigment flocculation would disadvantageously result in a decrease in physical strength of the colored film.

SUMMARY OF THE INVENTION

When forming a colored film by sol-gel methods, a specific mixture liquid containing metal alkoxide and coloring pigment along with fine or micro-particles of metal oxide and water plus alcohol is deposited on the front face of a panel, thus forming the intended colored film through a baking or sintering process. This colored film contains therein colloidal metal for facilitating dispersion of the pigment. Use of the colored film containing the colloidal metal makes it possible to obtain the colored film of less flocculation.

DESCRIPTION OF THE PREFERRED EMBODIMENTS

Preferred embodiments of the present invention will now be explained with reference to the accompanying drawings below.

Figure 1:
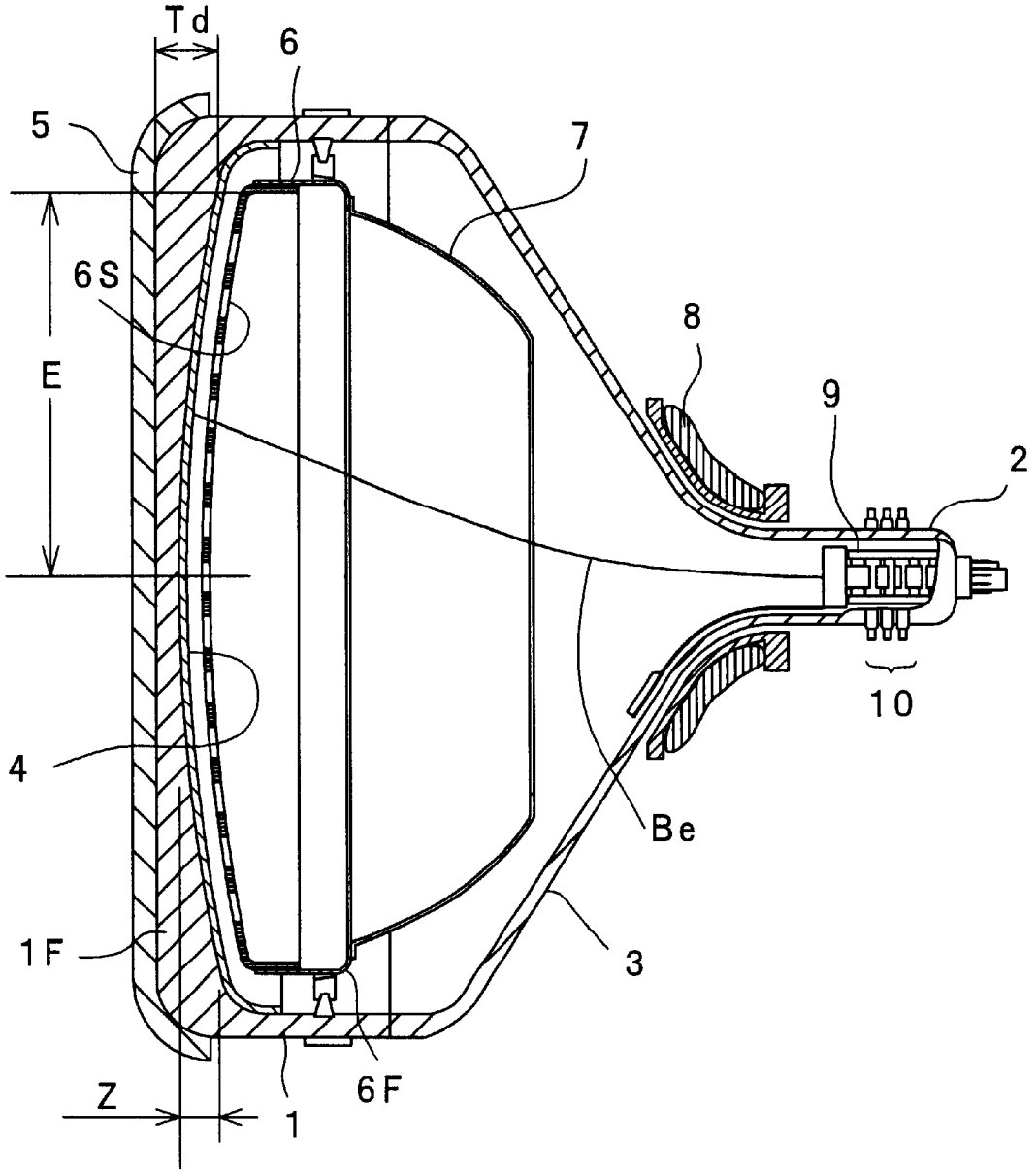
FIG. 1 is a diagram showing a cross-sectional view of a cathode ray tube in accordance with the present invention.

FIG. 1 is a diagram showing, in cross-section, a structure of main part of a cathode ray tube in accordance with the present invention.

A glass-made outer envelop (also known as bulb) which constitutes a color cathode ray tube comprise essentially of a panel section 1 disposed on the front side, an elongate neck portion 2, and a funnel section 3 that connects the panel section 1 and neck portion 2 together.

The panel section 1 includes a front face plate 1F and a skirt section coupled to the funnel section. The face plate 1F is formed of a glass substrate and has a display screen (screen) 4 on its inner surface and also has a thin film 5 on the outer surface thereof. The screen 4 is structured from a black matrix layer and a layer of fluorescent or phosphor elements luminescing in red, green and blue.

An electrode body structure for color selection is attached to inside of the panel section. A shadow mask body structure 6 of FIG. 1 is the electrode body structure for color selection. The shadow mask body structure 6 is structured from a shadow mask 6S having a plurality of electron beam passing apertures on the face plate 1F side, a mask frame 6F that holds the shadow mask 6S, and more than one spring secured to the mask frame 6F. The spring is fitted to a stud pin, which is installed inside of the panel.

An internal magnetic shield 7 is provided inside of a coupling portion of the panel section 1 and funnel section 3, and this internal magnetic shield 7 shields external magnetic fields. A deflection yoke 8 is disposed outside of a coupling portion of the funnel section 3 and neck portion 2.

The neck portion 2 that is elongated in a direction along the tube axis of the cathode ray tube contains therein an electron gun assembly 9. The electron gun assembly 9 is operable to emit three separate electron beams B from three inline-disposed cathodes toward the inner surface of the face plate.

Three electron beams B (only one is depicted in FIG. 1) as irradiated from the electron gun assembly 9 are deflected by the deflection yoke 8 to progress in a specified direction and, thereafter, travels through the shadow mask 6 to impinge on the phosphor film. Additionally a magnet group 10 for purity adjustment and convergence adjustment is disposed outside of the neck portion 2.

An image displaying operation of the color cathode ray tube with said arrangement is essentially the same as that of prior known color cathode ray tubes; thus, an explanation of the image display operation of this color cathode ray tube will be omitted herein.

In the case of a panel with a flat outer surface and a curved inner surface, a difference in glass plate thickness between a central portion and a peripheral portion becomes remarkable. When the equivalent curvature radius in a diagonal direction of the outer panel face becomes more than 10,000 mm, a difference in transmittance between the center and the periphery becomes greater. Due to this, the resulting contrast will also become different between the screen center and periphery.

The equivalent curvature radius RE may be defined by:

$$RE=(Z^2+E^2)/2Z,$$

where E is a distance from the face plate center to the periphery, and Z is a distance between the center and periphery in the tube axis direction (called depression size, also known as "sagittal height" in the art).

An aspheric surface panel is such that panel plate thickness differences on a diagonal axes and a long axis plus a short axis are settable in a way independent from one another, which in turn makes it possible to set up any required brightness or luminance values at respective portions of the face plate.

The cathode ray tube of FIG. 1 is such that the face plate's outer surface is greater in equivalent curvature radius than the inner face thereof; accordingly, a plate thickness at the face plate periphery is greater than that at the center.

In a respective one of the embodiments as will be discussed below, a semi-clear panel with its quality area of the screen is 46 cm and its transmittance of 80% was employed.

A definition equation of this panel's outer surface and inner surface is given as follows.

$$Z_0(X, Y)=Rx-[\{Rx-Ry+(Ry^2-Y^2)^{1/2}\}^2-X^2]^{1/2}$$

The term "$Z_0(X,Y)$" indicates a sagittal height from the screen center at a position of (X, Y) with the screen center being as an origin, where X and Y are the customary denominating letters for the coordinates of a point on the display surface.

The equivalent curvature radius is as shown in Table 1 below.

TABLE 1

Panel equivalent curvature radius

| | Outer Panel Face | Inner Panel Face |
|---|---|---|
| In Short Axis Direction: Ry (mm) | 80000 | 1870 |
| In Long Axis Direction: Rx (mm) | 50000 | 1990 |
| In Diagonal Direction: Rd (mm) | 57800 | 1950 |

Additionally a plate thickness at the panel center measures 11.5 mm; a plate thickness at a position of 240 mm in a diagonal direction is 25.3 mm.

In first and second embodiments, the thin film 5 is a single-layer film.

Figure 2:
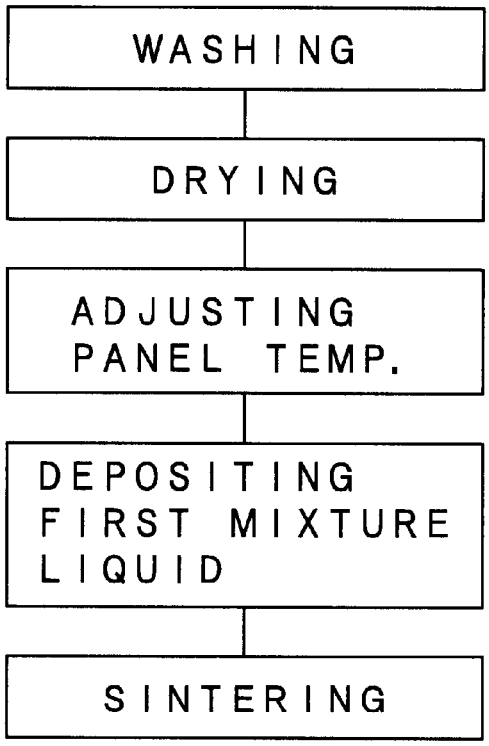
FIG. 2 is a flow diagram of the process for fabrication of a colored film.

FIG. 2 is a flow diagram showing some major process steps of fabricating a colored film. Firstly, wash the front surface of a panel for removal of contamination attached to the panel front panel face. Next, after having dried the resultant panel, adjust a temperature on the panel face in such a way as to fall within a range of 35±1° C. Let a mixture liquid 1 be spin-coated on the front face of the panel being presently kept at an appropriate temperature. Thereafter, heat the panel up to a temperature of 160° C. for 40 minutes; then, bake or sinter the mixture liquid 1 to thereby fabricate the thin film 5. A rotation speed of the panel during deposition of the mixture liquid is set at 150 rpm while setting a deposition time at 30 seconds.

Table 2 shows the composition of the mixture liquid 1 used for colored-film fabrication. In this embodiment an organic pigment (simply referred to as pigment hereinafter) was used as coloring matter whereas a pigment liquid was used as the mixture liquid 1.

TABLE 2

Composition of mixture liquid 1 (wt %)

| | | Liquids | | | |
|---|---|---|---|---|---|
| | | Pigment Liquid A | Pigment Liquid B | Comparative Liquid C | Comparative Liquid D |
| Component | | | | | |
| Organic Pigment | Quinacridone Red | 0.15 | 0.15 | 0.15 | 0.15 |
| | Phthalocyanine Blue | 0.05 | 0.05 | 0.05 | 0.05 |

TABLE 2-continued

| Composition of mixture liquid 1 (wt %) | Liquids | | | |
|---|---|---|---|---|
| | Pigment Liquid A | Pigment Liquid B | Comparative Liquid C | Comparative Liquid D |
| γ-glycidoxypropyl-trimethoxy silane | 0 | 0.5 | 0 | 0.5 |
| Colloidal Silica | 0.5 | 0.5 | 0 | 0 |
| Tetraethoxysilane | 1.0 | 1.0 | 1.0 | 1.0 |
| Ethanol | 80 | 80 | 80 | 80 |
| Pure Water | Residue | Residue | Residue | Residue |

In Table 2, the pigment liquid A is the pigment liquid in accordance with the first embodiment whereas the pigment liquid B is the pigment liquid in accordance with the second embodiment.

The organic pigments used are quinacridone red and phthalocyanine blue; silane coupling agent was γ-glycidoxypropyl-trimethoxy silane. The organic pigments are 30 nm in minimum particle diameter or size and 50 nm in average particle size. The greater the pigment particle size, the greater the convexo-concave irregularity in the surface of a pigment film; thus, the haze becomes greater. Hence, the coloring material is preferably designed to have a size less than or equal to a region in which Rayleigh scattering takes place. Practically, it is preferable that the particle size measures less than or equal to 100 nm; more preferably, 70 nm or less. Additionally, by setting the organic pigment at 20 nm or more in average particle size, dispersion of the organic pigment in alcohol liquid is well maintained by colloids.

A respective pigment liquid is pure water that contains therein 0.15 wt % of quinacridone red, 0.05 wt % of phthalocyanine blue, 1.0 wt % of tetraethoxysilane, 80 wt % of ethanol.

A comparative example C employs none of the γ-glycidoxypropyl-trimethoxy silane and colloidal silica. A comparative liquid D was designed to use 0.5 wt % of γ-glycidoxypropyl-trimethoxy silane as dispersing agent or dispersant. On the other hand, the pigment liquid A employed 0.5 wt % of colloidal silica as the dispersant. In addition, pigment liquid B used as dispersant 0.5 wt % of γ glycidoxypropyl-trimethoxy silane and 0.5 wt % of colloidal silica. The colloidal silica is 30 nm in average particle size.

Figure 3:
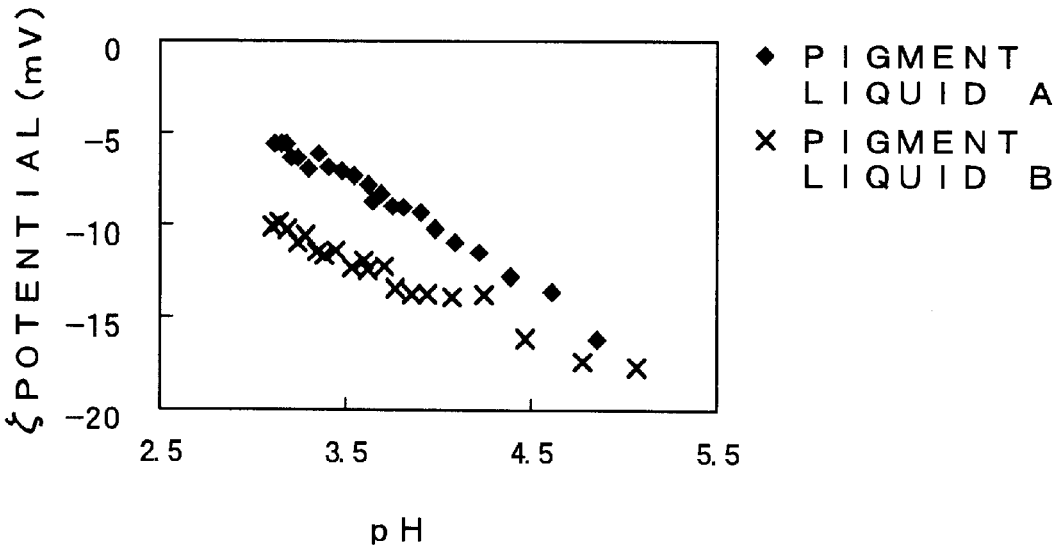
FIG. 3 is a graph showing a relationship between of ζ potential and pH of a pigment liquid 1 and that of pigment liquid 2.

FIG. 3 is a diagram graphically showing a relationship between electrokinetic potential (ζ potential) versus pH in the pigment liquid A and pigment liquid B. As readily seen from FIG. 3 also, the pigment liquid B with silane coupling agent added thereto is less in ζ potential change even upon changing of pH, when compared to that of the pigment liquid A with no silane coupling agent added thereto. This demonstrates that the pigment liquid B with silane coupling agent added thereto offers improved withstandability or durability (i.e. ability to retain the dispersion state of pigment used) against a pH deviation. Typically, silicon alkoxide is acid in nature. Upon addition of the silane coupling agent, this silane coupling agent behaves to cover or coat surfaces of layers of the colloidal silica and pigment liquid, causing the ζ potential to likewise increase in absolute value. Owing to this, the presently established dispersion will hardly be destroyed even when adding the silicon alkoxide to the pigment liquid. Hence, with co-use of the colloidal silica ($SiO_2$)-this is a metal oxide-and silane coupling agent together, it becomes possible to allow the pigment to further successfully disperse.

A respective one of the liquids set forth in Table 2 was deposited on a front panel surface, followed by sintering process to thereby fabricate a thin film. A colored film was then formed while controlling the film thickness d so that it measures 200±20 nm.

Table 3 below is the table for comparison of the colored film's characteristics.

TABLE 3

| Comparison of colored film characteristics | Films | | | |
|---|---|---|---|---|
| | Pigment Film E | Pigment Film F | Comparative Film G | Comparative Film H |
| Test Items | | | | |
| Light Absorption at 555 nm Wavelength | 0.162 | 0.175 | 0.128 | 0.135 |
| Peak (577 nm) Light Absorption | 0.195 | 0.210 | 0.149 | 0.155 |
| Luminous Haze (%) | 1.2 | 1.0 | 3.5 | 2.8 |
| Surface Roughness (nm) | 70 | 65 | 81 | 78 |
| Luminous Haze (%) after Ten-Time Repeating of −50 to 50° C. Temperature Cycle | 1.3 | 1.0 | 4.1 | 3.2 |
| Refractivity | 1.59 | 1.73 | 1.50 | 1.52 |

Comparative films G and H are the films manufactured by use of the comparative liquids C and D, respectively. In addition, pigment films E and F are the ones manufactured using pigment liquids A and B, respectively.

The pigment film E containing colloidal silica is improved in all the items of Table 3. With co-use of colloidal silica and silane coupling agent, it is possible to further improve all the items of Table 3.

First, compare the light absorption degree (555-nm wavelength) characteristics of the pigment films with those of the comparative films.

The light absorption degree (555-nm wavelength) of pigment film E is greater by 0.034 than that of the comparative film G and greater by 0.027 than that of the comparative film H. In addition, the light absorbability (555-nm wavelength) of pigment film F is greater by 0.047 than that of comparative film G and greater by 0.040 than that of comparative film H. Since the pigment films E and F are significant in light absorbability, the film thickness thereof may be reduced thus increasing the resultant film strength.

Next, compare the light absorbability (577-nm wavelength) characteristics of the pigment films with those of comparative films.

The light absorbability (577-nm wavelength) of pigment film E is greater by 0.046 than that of the comparative film G and greater by 0.040 than that of the comparative film H. In addition, the light absorbability (577-nm wavelength) of pigment film F is greater by 0.061 than that of comparative film G and greater by 0.055 than that of comparative film H. As the pigment films E and F are significant in light absorbability, the film's wavelength selective absorption effect becomes greater, thereby improving the contrast. It is also possible to reduce the pigment film thickness.

Figure 4:
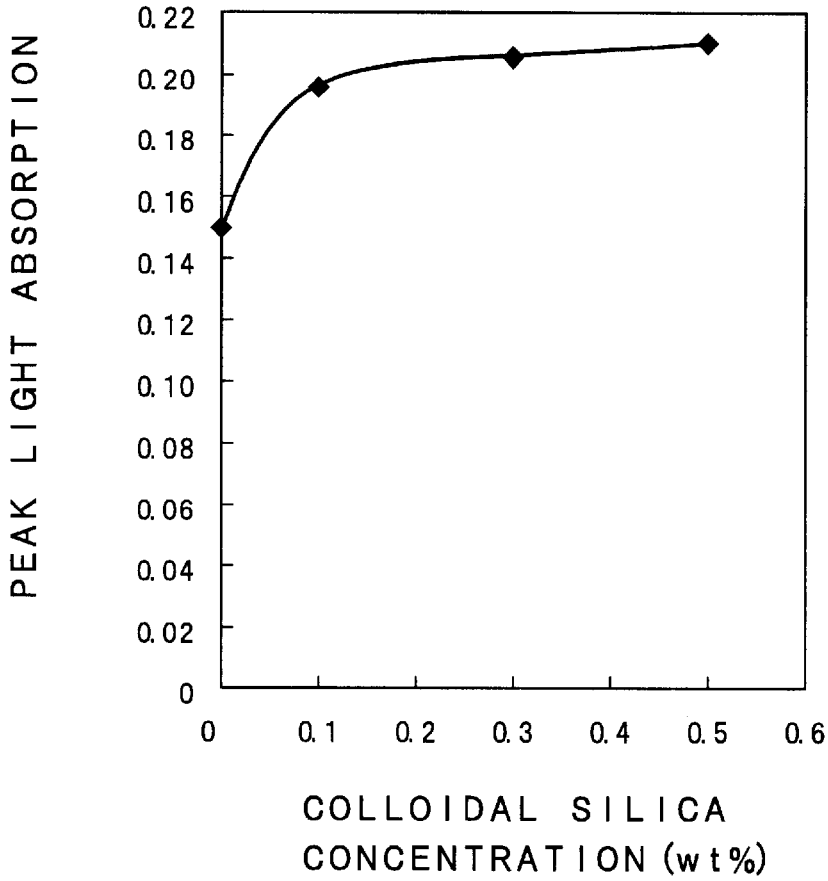
FIG. 4 is a graph showing a relationship between of the amount of colloidal silica added to a pigment liquid and the characteristic of peak light absorbability of a pigment film.

FIG. 4 is a characteristic diagram showing both an adding amount of colloidal silica to pigment liquid and the peak light absorbability (light absorbability of 577 nm) of pigment liquid.

A peak light absorbability in the case of precluding addition of colloidal silica (comparative film H) was at 0.155%. A peak light absorbability in case the colloidal silica adding amount is at 0.5 wt % or more becomes 0.21%, resulting in saturation of the light absorbability.

Adding colloidal silica having electrical charge carriers of the same kind as the pigment used permits the pigment to disperse due to repulsion of electrical charge. Owing to this action, it is possible to lessen flocculation of pigment in the state of the pigment liquid and pigment film. As a result, a spacing or gap within the pigment liquid decreases causing the pigment film to have a structure that approximates one of known close-packing structures.

Reduction of the gap in the pigment film results in an increase in pigment film's light absorbability per unit pigment film thickness of 200 nm. Thus it is possible to reduce the resulting thickness of the pigment film.

Preferably the particle size of colloidal silica is set at 1 to 1/20 of the pigment particle size. The diameter (particle size) of colloid particles used in the first and second embodiments is set at 1 to 100 nm. Letting colloid particles enter between pigment particles makes it possible to prevent unwanted contact and flocculation between pigments otherwise occurring due to the electrical restitution force of colloid particles. Adding the colloidal silica to the mixture liquid makes it possible to retain the pigment dispersion for an increased length of time period. More specifically, as electrostatically chargeable material is added to the pigment liquid, the pigment disperses successfully. It is possible to reduce the stirring operation.

In addition, it is required that a pigment film for selective absorption of wavelength be set at 85% or less. If the luminous transmittance goes beyond 85% then the resulting selective wavelength absorption effect decreases, thus making it impossible to improve the contrast of images. The pigment film E was 82% in luminance transmittance. This is because the pigment flocculation decreases causing the pigment film to have a close-packing structure.

On the contrary, in order to set the luminous transmittance of a film manufactured using the comparative liquid C at 82%, a film thickness of 380 nm was required.

Next, compare a relation of surface roughness to luminous haze of the pigment films with that of comparative films.

The surface roughness of the pigment film E is smaller by 11 nm than the comparative film G in average value and is smaller by 8 nm than the comparative film H in average value. The surface roughness of pigment film F can be made smaller by 16 nm than comparative film G in average value and be smaller by 13 nm than the comparative film H in average value. The surface roughness was represented by an average roughness Rz of ten separate points in accordance with the Japanese industrial standards (JIS), B0601. An evaluation length is about 2.5 mm.

Figure 5:
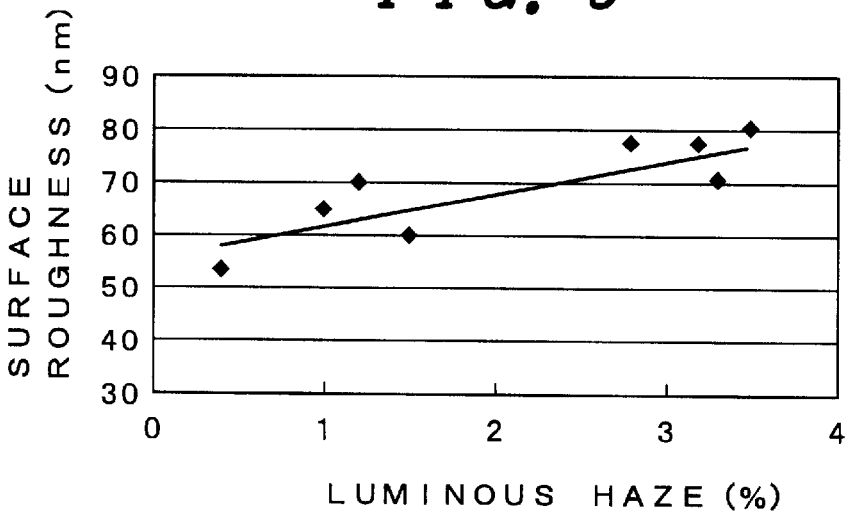
FIG. 5 is a graph showing a relationship between surface roughness and luminous haze.

FIG. 5 graphically shows a relationship between the surface roughness and luminous haze. Making the luminous haze smaller makes it possible to suppress blur of on-screen display images while simultaneously improving the contrast thereof. The pigment films E and F were capable of reducing the luminous haze to 1.5% or less. The pigment films E and F were also capable of setting the surface roughness at 70 nm or less.

In the prior art, even when employing organic pigment with its average particle size of 50 nm for fabrication of a colored film, such organic pigment tends to partly flocculate resulting in an increase in organic pigment particle size up to about 180 nm. Due to this, the pigment film has increased in surface roughness.

Since the colored film's surface roughness is made smaller, the luminous haze of pigment film E is smaller by 2.3% than that of comparative film G and smaller by 1.6% than comparative film H. The luminous haze of pigment film F is more excellent by 2.5% than that of comparative film G and better by 1.8% than comparative film H. As optical dispersion due to the colored film is less, it is possible to prevent image blur, which in turn makes it possible to display clear and distinct images.

The luminous haze was obtained from Equation 1.

$$\text{Luminous Haze } (\%) = \frac{\int_{380}^{780} T_d(\lambda) \times S(\lambda) D\lambda}{\int_{380}^{780} T_i(\lambda) \times (\lambda) d\lambda} \times 100 \qquad \text{[Equation 1]}$$

Here, Td(λ) is the diffuse transmittance, Ti(λ) is the integral transmittance, and S(λ) is the relative visibility, also known as luminous efficiency.

As the comparative films G and H are such that pigments flocculate therein, the substantial particle size of pigment becomes greater. Due to this, the irregular surface configuration of the comparative films becomes greater, resulting in an increase in luminous haze.

On the other hand, since the pigment films E and F each contain colloidal silica, lessening the pigment particle size of pigment liquid makes it possible to reduce any possible pigment film surface configuration, thus enabling reduction of the resulting luminous haze.

Next, compare the pigment films to the comparative films in luminous haze after completion of temperature change test procedure.

In FIG. 1, if the thin film 5 increases in thickness then crack can occur. If such crack is present in the thin film then the mechanical strength thereof decreases. Additionally, in case the thin film is a colored film for contrast improvement, the thin film decreases in contrast effect.

Comparing the luminous haze after completion of the temperature change test to that prior to the temperature change test, the comparative film G was degraded by 0.6% while the comparative film H was by 0.4%. On the contrary, the pigment film E was degraded by 0.1% whereas the pigment film F was not degraded in any way. The temperature change test is the test that repeats a temperature cycle of −50 to 50° C. for ten times in units of 24-hour time periods.

Figure 6:
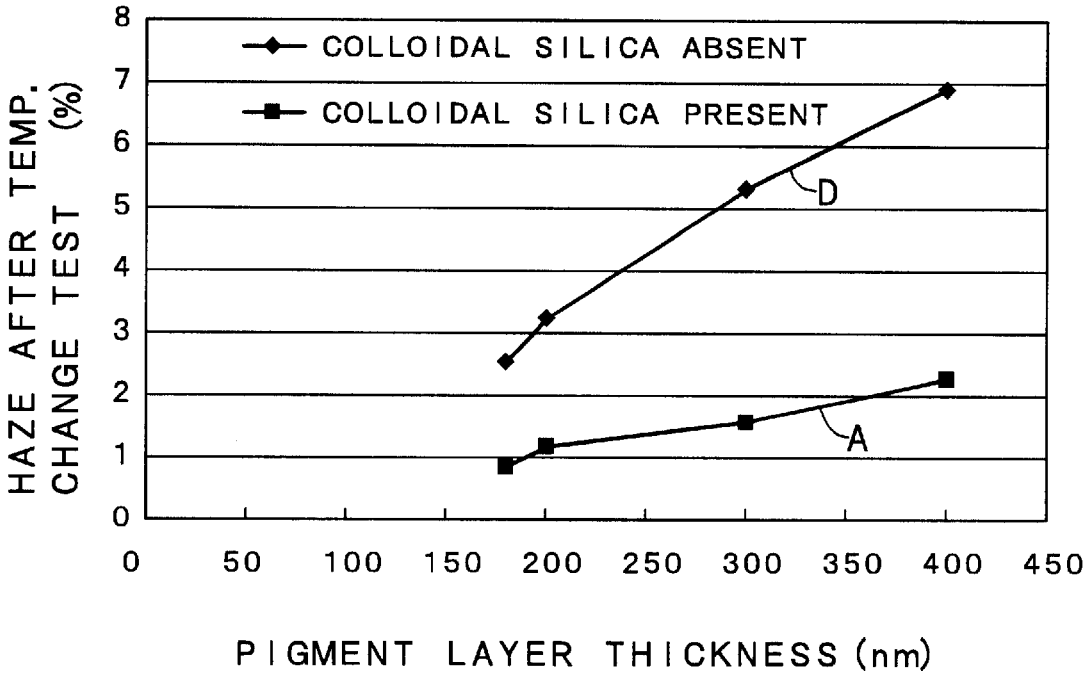
FIG. 6 is a graph showing a relationship between a pigment film thickness and luminous haze after having repeated for ten times a cycle of −50 to 50° C. in units of 24-hour time periods.

FIG. 6 is a graph showing a relationship between the pigment film thickness and luminous haze after having repeated the −50 to 50° C. temperature cycle for ten times.

Line "A" indicates the characteristics of a film that was manufactured using the pigment liquid A; line "D" shows the characteristics of a film manufactured using the comparative liquid D. The film thickness of each was changed from 175 up to 400 nm.

The film manufactured using comparative liquid D was such that the haze is 2.5% when the film thickness is set at 175 nm, and 6.9% when the thickness is 400 nm. When letting the film thickness change at 255 nm, the resultant haze change was 4.4%. In this way, the greater the film thickness, the greater the haze after the temperature change test.

In contrast thereto, the film manufactured using the pigment liquid A was such that the haze is 0.9% when the film thickness is at 175 nm, and 2.1% when the thickness is 400 nm. When the film thickness was changed to 255 nm, the haze change was 1.2%. This suggests that although the haze after the temperature change test increases with an increase in film thickness, its change rate stays less. For instance, the haze after the temperature change test of a film with a thickness of 300 nm is 1.5%, which is a sufficiently small value for practical use.

The pigment liquid with colloidal silica added thereto offers good affinity between colloidal silica and ethoxysilane so that it is easy for the ethoxysilane to percolate into gaps of pigment particles. Further, the pigment film containing colloidal silica is such that pigment particles densely overlap or "override" each other. Owing to this, the strength of the pigment film per se is improved thereby enabling prevention of cracking of the pigment film. In addition, the adhesive force between the face plate and pigment film is also improved by the silica which is obtainable through hydrolysis, dehydration and condensation plus sintering processes.

Figure 7:
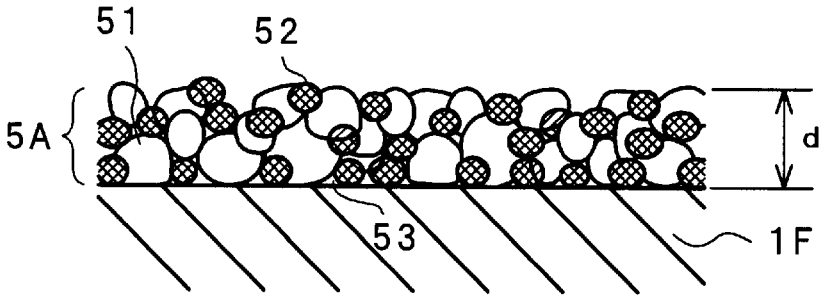
FIG. 7 is a diagram showing a sectional view of a pigment film.

FIG. 7 depicts a sectional view of the surface of a panel with the pigment film formed thereon. A single-layered thin film 5A is present on the surface of face plate 1F. The thin film 5A is comprised of pigment particles 51 made of quinacridone red and phthalocyanine blue, colloidal silica 52 for use as dispersant, silica 53 for filling gaps among pigment particles to thereby adhere the pigment particles together.

In order to obtain a film of practical strength, the film thickness required may be as small as possible. However, if the pigment film thickness becomes too small then it is impossible to obtain sufficient selective wavelength absorption effects. In addition, if the pigment density or concentration in pigment liquid is made higher in order to obtain sufficient selective wavelength absorption functionality, then a ratio of pigment 51 to silica 53 for use as binder (pigment/binder) becomes higher, resulting in a decrease in film strength. This suggests that it is difficult to form the pigment film with its thickness of less than 80 nm.

If the thickness of the pigment film is increased beyond 30 nm then the film strength becomes weaker while at the same time causing a surface configuration (swell) with significant period to occur on the resultant film surface, resulting in creation of film thickness irregularity or non-uniformity. Letting the pigment film thickness be set at 300 nm or less makes it possible to prevent image distortion otherwise occurring due to such film thickness irregularity. To be brief, the pigment film thickness is preferably set so that it falls within a range of from 80 to 300 nm.

The pigment film has its electrical resistance value of $1\times10^{12}$ Ω/square or greater, and is a dielectric film.

The pigment film E and pigment film F are 200 nm or less in thickness, and are the films having a luminous transmittance of 85%. Accordingly the pigment films E and F are excellent in contrast and simultaneously are hard films.

A thin film greater in hardness than the pigment films E and F is obtainable by formation of a silica film for pigment film protection on the pigment film.

It should be noted that although in the above-noted embodiments $SiO_2$ was used as principal material, the colloidal silica may be replaced with metal colloids of $Al_2O_3$,$ZrO_2$, and $TiO_2$ or the like for achievement of similar pigment flocculation suppressibilities. While these colloids of $Al_2O_3$,$ZrO_2$,$TiO_2$ or the like are dielectric metal oxide fine particles, these are metal colloids so that they adsorb ions or else existing in solvent on surfaces of colloid particles and are thus electrified. The same or similar pigment flocculation suppressibilities are also obtainable by use of metallic fine particles such as gold (Au), silver (Ag), palladium (Pd) or the like and conductive metal oxide microparticles including, but not limited to, indium tin oxide (ITO), antimony tin oxide (ATO), antimony oxide, tin oxide, niobium oxide. The dispersant may alternatively be a mixture of more than two kinds of materials selected from the group stated above. It means the metal colloid that disperse phase is metal or metal oxide.

Even when using conductive microparticles such as Au, Ag, Pd, ITO, ATO or else, conductive microparticles 52 are well dispersed within the colored film as shown in FIG. 7 due to the fact that the adding amount of such microparticles is less. Thus the pigment film measures $1\times10^{12}$ Ω/square or greater in resistance value and is a dielectric film.

Preferable selective wavelength absorptive materials for use in the embodiment structure other than the coloring matter recited in Table 1 include quinacridone-based pigment, dioxazine-based pigment such as dioxazine violet or the like, phthalocyanine-based pigment such as phthalocyanine green or else, acid red, azomethine yellow, metal complex azo-based pigment (yellow), and other similar suitable materials. Inorganic pigment such as carbon black or else may also be used. These coloring materials are employable solely or useable in the form of a mixture may be replaced by other possible metal alkoxides, a silicon alkoxide-added film was greater in strength than those with the remaining metal alkoxides added thereto.

With regard to the dispersant used, ethanol of Table 2 are replaceable with lower alcohol such as methanol, diacetone alcohol, isopropyl alcohol, ethyl-cellosolve (=2-ethoxyethanol) and others.

With third and fourth embodiments, the thin film 5 is formed of a multilayer film.

Figure 8:
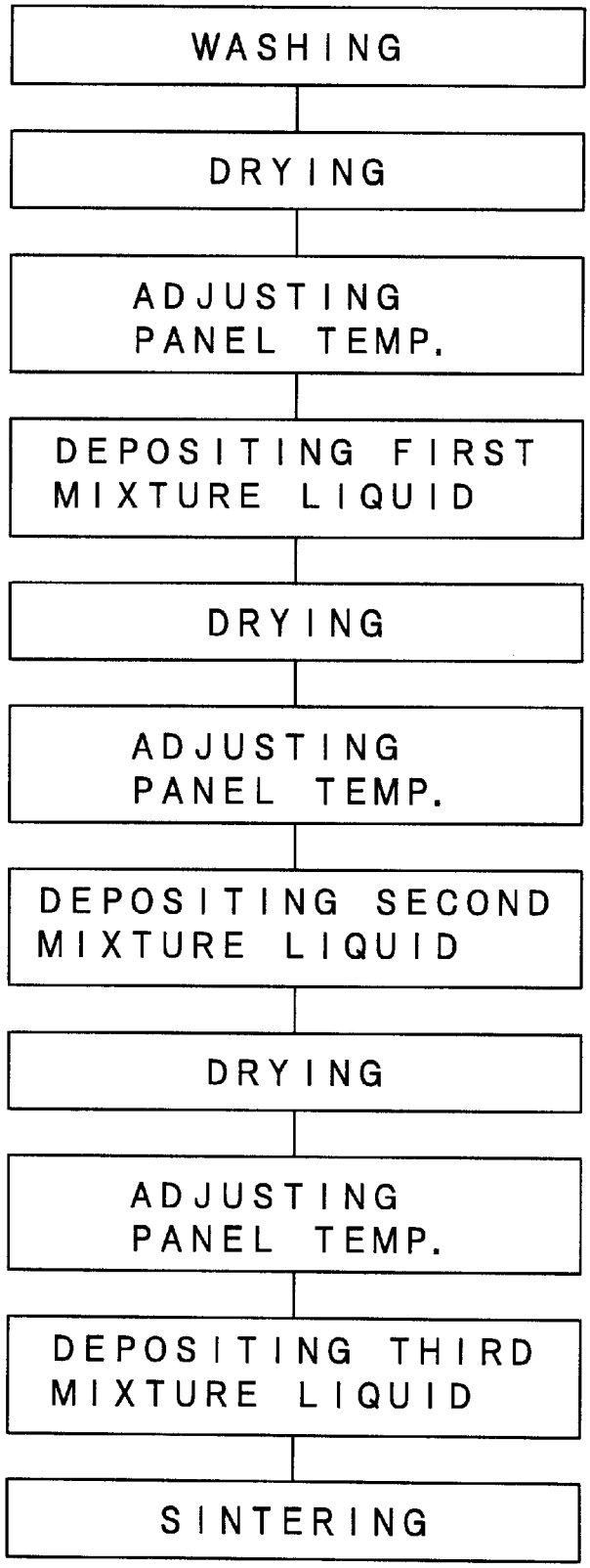
FIG. 8 is a flow diagram of the process for forming a multilayer film.

FIG. 8 is a flow diagram showing process steps for fabrication of the multilayer film.

First, wash the front surface of a panel for removal of contamination thereon. Then, dry the panel; next, adjust a temperature on the panel face at 35±1° C. Spin-coat a first mixture liquid on the panel front face which is kept at an appropriate temperature. Thereafter, dry the mixture liquid 1 as deposited on the front panel face to thereby fabricate a first layer. The panel's rotation speed during deposition of the mixture liquid is set at 150 rpm, and a deposition time duration is 30 seconds. After having formed the first layer, adjust the panel face temperature at 45±1° C. Next, spin-coat a second mixture liquid on the first layer; thereafter, dry the second mixture liquid deposited on the front panel face, thus forming a second layer. After formation of the second layer, adjust the panel surface temperature at 45±1° C. Thereafter, spincoat a third mixture liquid on the second layer. A rotation speed of the panel during deposition of the second mixture liquid and third mixture liquid is set at 150 rpm, and deposition time is 60 seconds. After having deposited the third mixture liquid, heat the panel up to 160□ C. for 30 minutes; then, sinter the first and second layers along with the third mixture liquid to thereby form a multilayer film 50.

The first mixture liquid is such that the same comparative and pigment liquids as those in the first embodiment were used.

Table 4 below shows the composition of the second mixture liquid used to form a conductive layer(s).

TABLE 4

Composition of liquid for conductive film fabrication (wt %)

| Components | Concentration (wt %) |
|---|---|
| Ag, Pd | 1.0 |
| Ethanol | 90 |
| Pure Water | Residue |

The conductive film formation liquid is added with conductive particles, such as particles of silver (Ag) and palladium (Pd). Ag and Pd particles are 20 nm in average particle size.

Table 5 shows the composition of third mixture liquid used for forming a silica layer. The third mixture liquid used was a silicon alkoxide liquid.

TABLE 5

Composition of silicon alkoxide liquid

| Components | Concentration(wt %) |
|---|---|
| Tetraethoxysilane | 1.0 |
| Ethanol | 80 |
| Nitric Acid | 0.05 |
| Pure Water | Residue |

When tetraethoxysilane is dissolved in ethanol for use as a solvent followed by addition thereto of nitric acid and water, the silicon alkoxide liquid exhibits hydrolysis reaction and dehydration/condensation reaction, resulting in creation of siloxane bonding. Thereafter, sintering is done to thereby form a silica layer.

Appropriate process control was done for letting the pigment layer measure 200±20 nm in film thickness, the conductive layer be 25±5 nm in film thickness, and the silica layer be 75±5 nm in thickness, thus forming the intended thin film.

Table 6 shows the characteristics of multilayer films I, J that were formed by use of the pigment liquids A, B in comparison with those of comparative films K, L formed using comparative liquids C, D. The multilayer film I is the third embodiment whereas the multilayer film J is the fourth embodiment.

TABLE 6

Comparison of three-layered films

| | Films | | | |
|---|---|---|---|---|
| | Multilayer Film I | Multilayer Film J | Comparative Film K | Comparative Film L |
| Test Items | | | | |
| Luminous Haze (%) | 1.5 | 0.4 | 3.2 | 3.3 |
| Luminous Reflectivity (%) | 1.3 | 0.9 | 2.5 | 2.2 |
| Surface Roughness (nm) | 60 | 53 | 78 | 71 |
| Strength | 7H | 9H | 6H | 6H |
| Sheet Resistance Value (Ω/square) | 820 | 600 | 1100 | 1030 |

Figure 9:
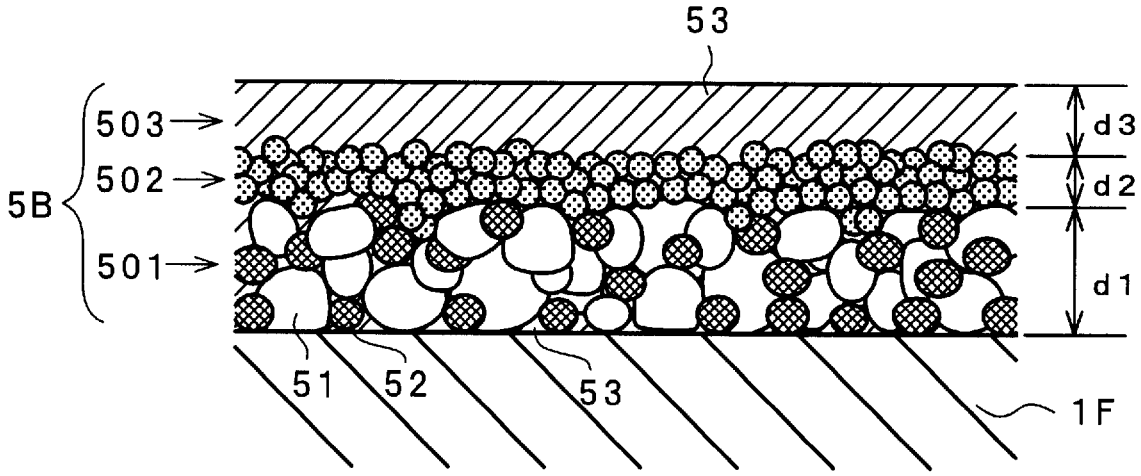
FIG. 9 is a sectional view of the multilayer film.

FIG. 9 is a sectional view diagram showing an arrangement of a thin film 5B, which is the multilayer film of the present invention.

The thin film 5 formed on a panel glass plate is arranged to include a pigment layer 501, conductive layer 502, and protective layer 503.

The pigment layer is the same in arrangement as the pigment film of the embodiment 1, and is formed of pigment particles 51 comprising quinacridone red or phthalocyanine blue, colloidal silica 52 for use as dispersant, silica 53 for filling gaps among the pigment particles to thereby adhere the pigment particles together.

The second layer is designed so that microparticles of gold (Au) and palladium (Pd) are tightly adhered together by the silica serving as a binder.

The third layer that is the protective layer 503 is a silica layer as formed through hydrolysis reaction and dehydration/condensation reaction of a silicon alkoxide liquid.

In case the pigment layer 501 for use as the first layer has a film thickness d1 of 80 to 300 nm, it will be preferable in a view point of optical characteristics and resistance reduction that the second layer has its film thickness d2 of 15 to 50 nm while letting the third layer have a thickness d3 ranging from 50 to 140 nm.

Additionally the conductive layer 502 has a film thickness d2 of 25 nm. A practically recommendable thickness d2 of such conductive layer falls within a range of 15 to 35 nm.

The multilayer film I and multilayer film J are such that the luminous haze is at 1.5% or less.

Fabrication of the conductive layer on the pigment layer permits the resulting surface roughness to be made smaller than that of single-layer films as a whole. This multilayer film surface roughness reduction results in the luminous haze of the multilayer film I being lessened by 1.7% than that of comparative film K and by 1.8% than comparative film L. In addition, the luminous haze of the multilayer film J is made smaller by 2.8% than that of comparative film K and better by 2.9% than comparative film L. The smallness of luminous haze makes it possible to suppress unwanted out-of-focusing or blur of images, which in turn enables successful on-screen displaying of clear and crisp images. Preferably the luminous haze is set at 1.0% or less.

Generally a film with optical absorbability is such that the film thickness of an m-th layer can be represented by "dm," and its complex index of refraction is given as nm-i×km (m=1, 2, 3, . . .). Here, "nm" is the refractivity, and "km" is the attenuation coefficient.

The multilayer film comprise of a lamination of the first layer, second layer, and third layer in this order of sequence when looking at from the panel side. The first layer in contact with the panel is the pigment layer with selective wavelength absorbability. The second layer formed on or over the pigment layer is a conductive layer. The third layer formed overlying this conductive layer is a silica layer for thin-film protection. The first layer refractivity n1, second layer refractivity n2 and third layer refractivity n3 are in the relation of n3<n2<n1.

Especially the inventors as named herein have found that in the three-layer structure consisting of the pigment layer and conductive layer plus low-refractivity layer, both the contrast function and low reflection are successfully achievable by appropriate definition of refractivities of the first and second layers in the way stated supra.

Figure 10:
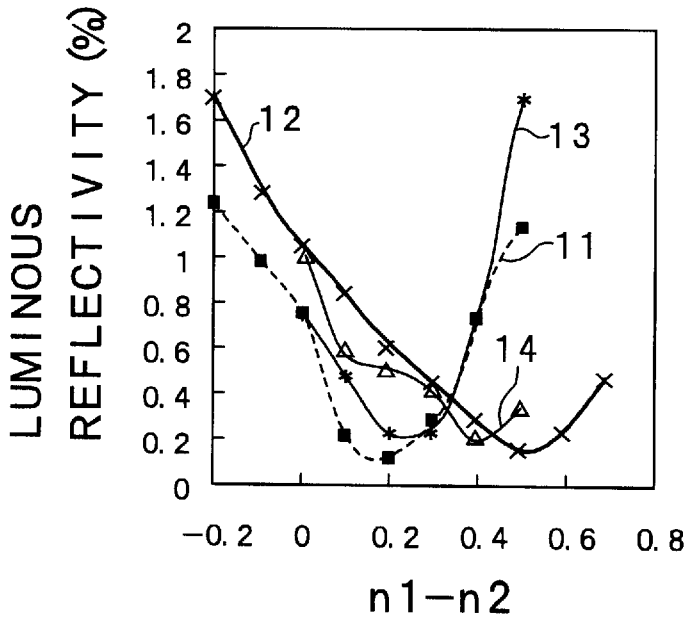
FIG. 10 is a graph showing a relation of a difference in refractivity between first and second layers versus luminous reflectivity.

FIG. 10 is a graph showing the relation of a difference in refractivity between the first and second layers versus the luminous reflectivity thereof. Line 11 is the luminous reflectivity obtained when the film thickness d1 of the pigment layer of the first layer measures 100 nm; line 12 is that obtained when the film thickness d1 of pigment layer is 150 nm; line 13 is that obtained when the pigment film thickness d1 is 200 nm; and, line 14 is when the pigment film thickness d1 is 300 nm. Additionally the second layer has its film thickness d2 of 25 nm whereas the third layer film thickness d3 is 75 nm. The conductive layer has a complex refractivity of 1.47–0.43i at 555 nm.

To reduce the luminous reflectivity, let n1−n2 (difference between the first layer's refractivity n1 and second layer's refractivity n2) >0. Further, selecting the value of n1−n2 within a range of from 0.1 to 0.6 makes it possible to obtain the lowest luminous reflectivity at each film thickness.

Additionally, in case the second layer is made of ITO that is high in refractivity, it is possible to lower the luminous reflectivity by letting microparticles of chosen material higher in refractivity than ITO be dispersed within a colored layer which is the first layer and also controlling the difference in refractivity between the colored layer and conductive layer in such a way as to fall within a range of 0.1 to 0.6. In other words, the luminous reflectivity may be lowered by letting specific material high in refractivity than the material forming the conductive layer be dispersed in the pigment layer. With the present invention, it becomes possible to allow the colored layer to be greater in refractivity than the conductive layer.

In addition, the refractivity of the colored layer is readily adjustable through appropriate adjustment of the amount of high-refractivity microparticles as contained in the pigment layer. Especially the pigment layer is capable of achieving selective wavelength absorbability while simultaneously reducing the luminous reflectivity because of the fact that it contains therein colloidal silica for improvement of pigment dispersion and also conductive microparticles for enhancing the refractivity such as ATO microparticles or ITO microparticles or else.

Figure 11:
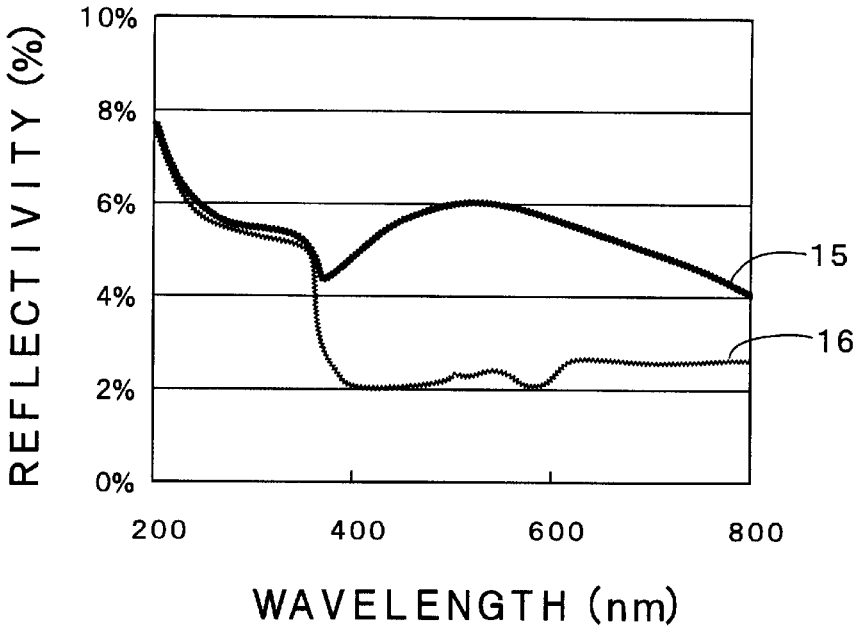
FIG. 11 is a graph showing a relationship between from-the-inner-face reflectivity and wavelength.

FIG. 11 is a graph showing a relation of from-the-inner-face reflectivity versus wavelength. The internal reflectivity of a double-layer film is compared with that of a three-layer film, wherein the former is a lamination of the pigment film B and the protective film (silica film) formed thereon whereas the latter is the multilayer film J. Within a wavelength region between 400 and 800 nm, the double-layer film's internal reflectivity varies in a range of 4 to 6%, resulting in observation of a curve that has a hump peaked at 550 nm. On the contrary the internal reflectivity of three-layer film changes within a range of 2 to 2.5%. In summary, in the visible light region, the three-layer film of the subject embodiment may offer more enhanced internal reflection suppressibility than the double-layer film. Note that the above-noted reflectivity is the reflectivity measured in positive reflection events. Additionally the reflectivity was detected from a specified location oppositely distant by 5° from a perpendicular line to a sample surface while letting light obliquely fall onto the sample surface at an angle of 50° relative to the perpendicular line.

The multilayer film I has its surface or "sheet" resistance of 820 Ω/square, and multilayer film J is 600 Ω/square in sheet resistance. Any one of these films could be smaller in sheet resistance value than the comparative films K and L. In addition, as the sheet resistivity is sufficiently small, it is possible to suppress or minimize any possible electromagnetic wave leakage toward the front panel face side of the cathode ray tube.

Since the multilayer film I is less in pigment layer surface roughness (convexo-concave irregularity) than the comparative film K and comparative film L, it is possible to prevent any undesired breakage or cutoff of an electrical conduction path of the conductive layer. Due to this, it is possible for the multilayer film I to made much smaller its sheet resistivity than the comparative films K and L. As the multilayer film J is less than multilayer film I in pigment layer surface configuration, it is possible to fabricate any intended conductive layer that has better thickness uniformity than the multilayer film I. Hence, the multilayer film J is capable of reducing the sheet resistivity more successfully than multilayer film I.

Although in the above-stated embodiments the conductive microparticles are set at 20 nm in average particle size, it is permissible for these particles to measure 2 to 35 nm in average particle size for practical implementation purposes. In addition, the conductive microparticles may be conductive metal oxide microparticles such as for example ITO, ATO or else, other than noble metal microparticles of gold (Au), silver (Ag), palladium (Pd), etc. Additionally, since the conductive layer is formed with conductive microparticles tightly adhered and bound together, it is possible to make smaller the roughness on the upper surface of the conductive layer than the surface roughness of the pigment layer even where the underlying pigment layer's surface stays rough.

The strength of the thin film was evaluated in accordance with the pencil hardness test of JIS K5400.

The strength of the multilayer film I is 7H whereas that of the multilayer film J is 9H. This demonstrates that these films are stronger than the comparative film K and comparative film L.

The film thickness in the above embodiments is represented by an average value of those values measured at ten separate locations.

The conductive layer and protective layer may be formed by deposition techniques. In this case, however, the conductive layer and protective layer are greatly affected by the surface configuration of the pigment layer.

The protective layer may be made of magnesium fluoride (MgF) or calcium fluoride (CaF).

To further improve the contrast of on-screen images, a colored panel glass plate may be used.

Figure 12:
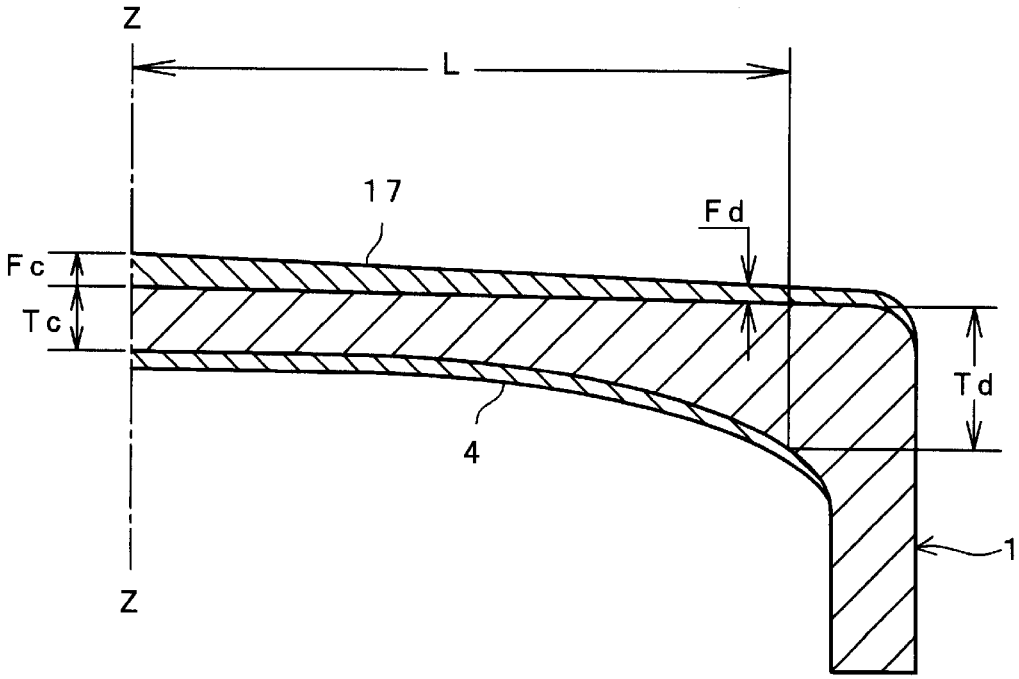
FIG. 12 is a partly sectional view of a panel section of a cathode ray tube with a thin film formed thereon.

FIG. 12 depicts a partly sectional view of the panel section of a flat-type cathode ray tube.

The panel of FIG. 12 is the same as that of FIG. 1.

The panel 1 is arranged so that a thin film 17 is formed on the outer surface of a display window. The panel 1 is such that a plate thickness Tc at a central portion of the display is less in value than a plate thickness Td at a peripheral portion thereof (Tc<Td).

A film thickness Fc of the thin film 17 at the display center is greater than a film thickness Fd of thin film 17 at the display periphery (Fc>Fd). In other words, the thin film 17 is different in thickness between the display center and the periphery. With such an arrangement of the thin film 17 shown in FIG. 12, it is possible to correct any possible differences in contrast between the display center and periphery occurring due to the panel plate thickness difference.

Figure 13:
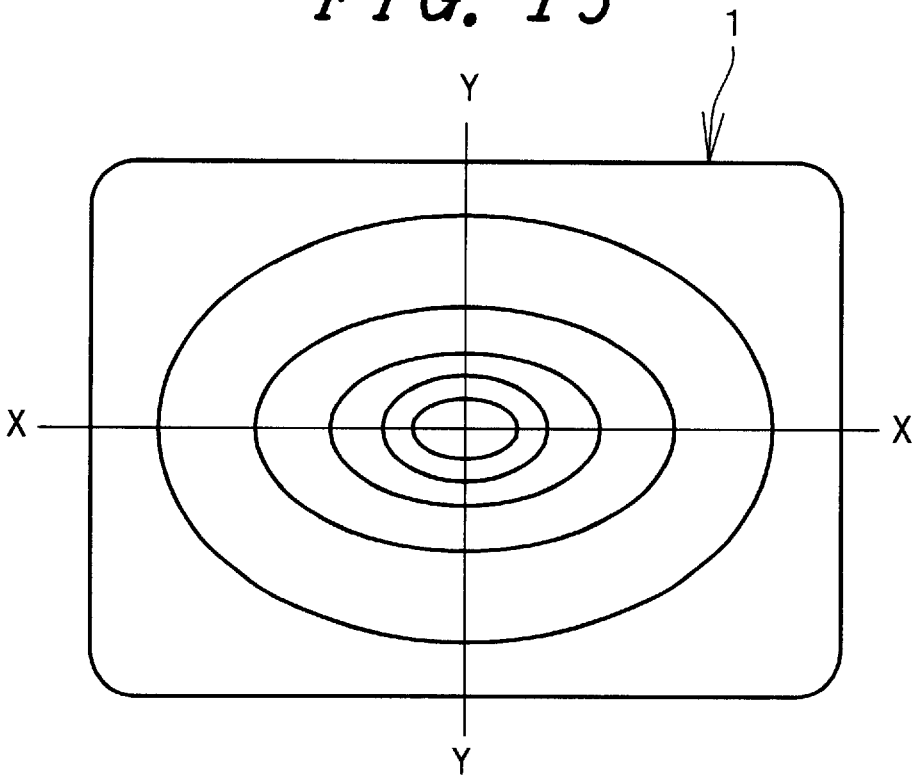
FIG. 13 is a diagram for explanation of a thickness distribution of the thin film.

FIG. 13 is a diagram for explanation of a distribution of thickness values of the thin film 17, and shows a pattern of equal-height or "contour" lines. The thin film 17 contour lines each have an ellipse-like shape, which has its long axis in an X-axis direction and short axis in Y-axis direction. Alternatively the thin film 17 may be formed so that contours become concentric circles or longitudinally elongate ellipses.

Figure 14:
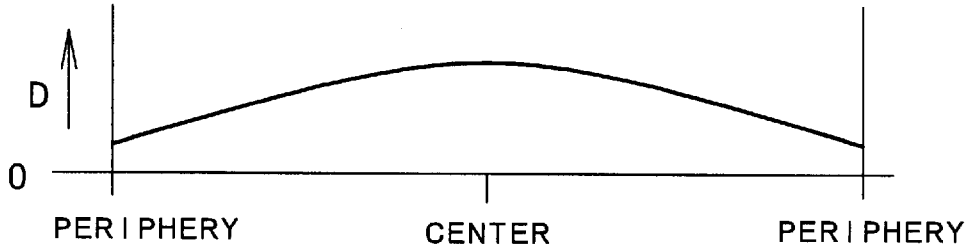
FIG. 14 is a diagram showing a change in thickness of the thin film.

FIG. 14 is a graph showing a change in thickness of the thin film 17. The thin film 17 is thickest at the display center and thinnest at the display periphery. With such an arrangement, it is possible to improve a transmittance difference and contrast difference between the center and the periphery of the display window.

Flattening the display panel makes it possible to improve the viewability of on-screen images. It is also possible to improve the contrast when using a panel of high transmittance.

Figure 15:
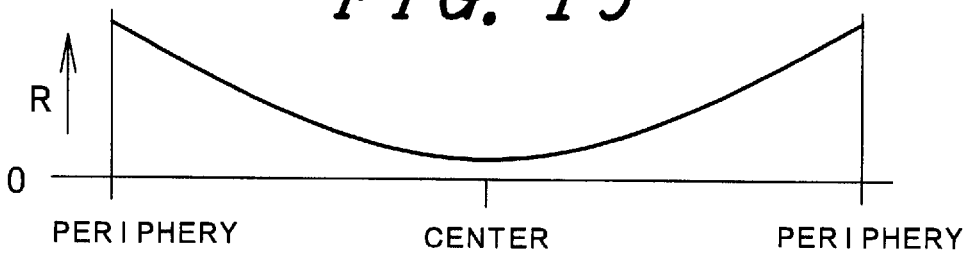
FIG. 15 is a diagram showing a change in thickness of the thin film.

FIG. 15 is a graph showing a change in thickness of a thin film 17 which is formed for use with a cathode ray tube of the type wherein the panel plate thickness at the display center is greater than that at the periphery. By forming a thin film with a thickness at the display center being less than that at the periphery on such cathode ray tube with the panel plate thickness at the display center being greater than that at the periphery, e.g. a cathode ray tube as recited in Japanese Patent Lied Open No. 11-238481, it is possible to improve the contrast difference between the display center and the periphery.

Using the arrangement stated above, the present invention is capable of providing the intended colored film which is less in film thickness. Further, the present invention can improve the light absorbability of such colored film and also provide the thin film capable of suppressing undesired scattering of light rays due to the presence of the colored film.

Although in any one of the above-stated embodiments the cathode ray tube is used as image display apparatus, the principal features of the invention are also applicable to visual display equipment including, but not limited to, electro-luminescent display (ELD), plasma display panel (PDP), liquid crystal display (LCD), vacuum fluorescent display (VFD), and field emission display (FED) devices.

What is claimed is:

1. A cathode ray tube comprising:

a panel section having its inner surface with a plurality of phosphor layers formed thereon, a neck portion housing therein an electron gun assembly, and a funnel section for coupling said panel section and said neck portion together, wherein said panel has a film on a front face thereof, and that said film comprising a colored layer including pigment and fine particles of at least one material as selected from the group consisting of $SiO_2$, $Al_2O_3$, $ZrO_2$, and $TiO_2$, an electrically conductive layer, and a protective layer, said film falls within a range of 80 to 300 nm in film thickness of a pigment layer, ranges from 15 to 50 nm in film thickness of the conductive layer, and ranges from 50 to 140 nm in film thickness of the protective layer, and said film is less than or equal to 1.5% in luminous haze.

2. A cathode ray tube comprising:

a panel section having its inner surface with a plurality of phosphor layers formed thereon, a neck portion housing therein an electron gun assembly, and a funnel section for coupling said panel section and said neck portion together, wherein said panel has a film on a front face thereof, and that said film comprising a colored layer including pigment and fine particles of at least one material as selected from the group consisting of $SI0_2$, $Al_2O_3$, $ZrO_2$, and $TiO_2$, an electrically conductive layer, and a protective layer, said film falls within a range of 80 to 300 nm in film thickness of a pigment layer, ranges from 15 to 50 nm in film thickness of the conductive layer, and ranges from 50 to 140 nm in film thickness of the protective layer, said panel has an outer face measuring 10,000 mm or greater in equivalent radius of curvature in a diagonal direction, and the film is such that a film thickness at a central portion of a display screen is greater than a film thickness at a peripheral portion of the screen.

3. A cathode ray tube comprising a panel section having its inner surface with a plurality of phosphor layer formed thereon, a neck portion housing therein an electron gun assembly, and a funnel section for coupling said panel section and said neck portion together, characterized in that said panel section has on a front face thereof a pigment film including pigment and fine particles of any one of a noble metal and a metal oxide, and that said film is greater than or equal to $10^{12}$ Ω/square in sheet resistance.

4. A cathode ray tube according to claim 3, wherein said fine particles are of at least one material as selected from the group consisting of Au, Ag, Pd, $Al_2O_3$, ITO, ATO, antimony oxide, tin oxide, and niobium oxide.

* * * * *